US005241761A

United States Patent [19]

Hauser

[11] Patent Number: 5,241,761

[45] Date of Patent: Sep. 7, 1993

[54] DRYER SECTION FOR A PAPER MAKING MACHINE WITH DIFFERING SUCTION ROLLS

[75] Inventor: Ludwig Hauser, Heidenheim, Fed. Rep. of Germany

[73] Assignee: J.M. Voith GmbH, Fed. Rep. of Germany

[21] Appl. No.: 844,145

[22] Filed: Mar. 2, 1992

[30] Foreign Application Priority Data

Dec. 21, 1991 [DE] Fed. Rep. of Germany ..... 4142524

[51] Int. Cl.[5] ..... F26B 11/02

[52] U.S. Cl. ..... 34/117; 34/114; 34/123; 162/363

[58] Field of Search ..... 34/114, 115, 116, 117, 34/120, 123; 162/363, 207

[56] References Cited

U.S. PATENT DOCUMENTS

| | | | |
|---|---|---|---|
| 3,868,780 | 3/1975 | Soininen et al. | 34/116 |
| 4,202,113 | 5/1980 | Kankaanpaa | 34/41 |
| 4,481,723 | 11/1984 | Vedenpää34 | 117/ |
| 4,625,430 | 12/1986 | Aula et al. | 34/41 |
| 4,677,762 | 7/1987 | Futcher | 34/117 |
| 4,972,608 | 11/1990 | Iivespää34 | 115/ |
| 5,022,163 | 6/1991 | Ilvespaa et al. | 34/23 |
| 5,046,266 | 9/1991 | Autio | 34/115 |

FOREIGN PATENT DOCUMENTS

| | | |
|---|---|---|
| 8300514 | 1/1983 | World Int. Prop. O. . |
| 8804206 | 6/1988 | World Int. Prop. O. . |

*Primary Examiner*—Henry A. Bennet
*Assistant Examiner*—Denise L. Gromada
*Attorney, Agent, or Firm*—Ostrolenk, Faber, Gerb & Soffen

[57] ABSTRACT

A dryer section for a machine for drying a fibrous web and particularly a paper web. The dryer section comprises a row of dryer cylinders which alternate with reversal suction rolls along the path of the web. The dryer cylinders are separated into at least an upstream first dryer part and a downstream second dryer part in the path of the web through the dryer section. A continuous supporting belt travels along with the web alternately over each dryer cylinder and its associated suction roll in respective dryer groups in each of the upstream and downstream dryer parts. Every suction roll in the upstream first part has a stationary suction box in it. Every suction roll in the downstream second part does not have a suction box. All of the suction rolls have a perforated roll shell. The density of the perforations in the roll shell of the suction rolls in the first upstream part is at least twice as great as the density of the perforations in the roll shell of the suction rolls in the second downstream part. The first suction rolls have a smaller diameter than the second suction rolls.

15 Claims, 2 Drawing Sheets

DRYER SECTION FOR A PAPER MAKING MACHINE WITH DIFFERING SUCTION ROLLS

BACKGROUND OF THE INVENTION

The present invention relates to a dryer section of a paper making machine. The dryer section is made up of a plurality of dryer groups. Each group is comprised of a series of heated dryer cylinders with each cylinder followed by a reversal roll, typically with a suction capability. The web travels through each dryer group in a meander path, over one side, e.g. the top, of a dryer cylinder and over the opposite side, e.g. the bottom, of the next reversal roll, over the one side of the next dryer cylinder., etc. A continuous endless loop supporting belt, e.g. a porous dryer felt or a screen-like dryer fabric screen travels with the web through each dryer group. Prior art on such a dryer section is represented by FIG. 1 of International Application WO 88/04206 and by U.S. Pat. No. 5,065,529.

Dryer sections of this type are intended for drying a fibrous web, e.g. a paper web, especially in a paper making machine designed to run at very high speeds, on the order of 1000–2000 m/min. One requirement for such a dryer section is that the web travel through the machine as reliably as possible without tearing, despite its extremely high speed. In other words, the runability must be very high. The fibrous web and its supporting belt are advanced through the dryer section with the aid of the reversal suction rolls between the dryer cylinders. Critical points are where the web, resting on the supporting belt, e.g. the dryer felt, leaves its direct contact with a dryer cylinder to move to the suction roll that follows. Another requirement is that the dryer cylinders dry the web as effectively as possible so that only a reasonable number of cylinders will be needed despite the extremely high web speed. When fewer dryer cylinders are employed, the entire dryer section can be shorter.

SUMMARY OF THE INVENTION

An object of the present invention is to improve a known dryer section of a paper making machine by simplifying it and by increasing both the runability and the efficiency of the individual dryer cylinders.

It has been discovered that this and other objects can be satisfied to a greater extent and at less expense than previously with the following combination of features. Upstream in the dryer section, where the web is still relatively wet, where the web is accordingly still not very resistant to tearing, and where the web still adheres relatively strongly to the surface of each dryer cylinder, the suction rolls are of the type called suction box rolls, which are known in the art and are described in International Application WO 83/00514 and in numerous U.S. Pat. Nos. e.g. 1,656,853 and 1,832,974. They have a stationary suction box which defines a suction zone which extends over an arc that corresponds to the part of the circumference of the suction box roller over which the belt passes with the web on it. A perforated shell rotates over the suction box so that those perforations then passing over the arcuate suction box transmit suction through the supporting belt to the web supported on the belt. In the invention, these suction box rolls have a relatively greater density of perforations passing through their rotatable shell so that they generate a very powerful vacuum through the perforations then passing over the suction box and therefore through the supporting belt to the web supported on the belt, in particular where the web is leaving the immediately preceding dryer cylinder. As a result, even though the web is still very wet, the web, which is resting on the belt, will separate intact from the dryer cylinder. Thus, there is less risk of tearing, i.e., the runability will be high.

Suction box rolls are rather complicated structures because, in addition to their perforated roll shell, they require a stationary suction box, which is located preferably inside the roll shell. The invention accordingly uses suction box rolls only in the upstream part of the dryer section, which is upstream along the path of the web through the dryer section. By the time the web has reached the downstream part of the dryer section, the web moisture content has dropped to a prescribed level, at which the tensile strength of the web is higher and the adhesion of the web to the dryer cylinder is weaker. There, substantially less vacuum is needed to pull the web off the dryer cylinders, and ordinary suction rolls can be employed in the downstream part. These ordinary rolls lack suction boxes and are accordingly less expensive. An ordinary suction roll also has a hollow rotatable roll shell, which is perforated and a vacuum is applied to the interior of the roll to apply suction through all of the perforations. The roll shell of the ordinary suction roll has a relatively lower density of perforations than do the suction box rolls. In addition, peripheral grooves may be provided in the roll shell. These rolls are known from U.S. Pat. No. 3,630,424 or U.S. Pat. No. 5,022,163.

It is a characteristic of the dryer section of the invention that two different kinds of suction rolls are employed, specifically suction box rolls in the upstream part, which may be approximately the upstream half, of the dryer section and ordinary suction rolls in the downstream part, which may be approximately the downstream half of the section. If a typical dryer section has a plurality of dryer groups, e.g. four, the first two dryer groups would use suction box rolls, while the last two dryer groups would use ordinary (box-less) suction rollers. But, the invention does not require an equal number of dryer groups in each of the upstream and downstream parts of the dryer section or an equal number of dryers in each dryer group or that the division between the upstream and downstream parts of the dryer section be between two dryer groups. That division may be in the middle of one of the dryer groups.

Although both above described types of suction roll can have the same diameter, it is advantageous for the ordinary suction rollers in the downstream part to have greater diameters than the suction box rolls in the upstream part. This larger suction roll feature will considerably improve the specific drying, which is the drying capacity of each individual dryer cylinder, because it provides a longer evaporating length between each two neighboring dryer cylinders in the downstream part in spite of the relative proximity of each dryer cylinder to its associated suction roll that is necessary for a high runability.

The suction box rolls in the upstream part of one embodiment of the dryer section of the invention have a smaller diameter, which decreases their manufacture or purchase costs and also takes into consideration that longer evaporating lengths between neighboring dryer cylinders are not as necessary in the upstream part as they are in the downstream part of the dryer section. On the other hand, the ordinary rolls without suction boxes in the downstream part have the greater diameter. This larger diameter feature is substantially less expensive to provide in rolls without suction boxes than in those with suction boxes. In other words, all of the web path reversal suction rolls in the upstream part of a particular practical embodiment of the invention are suction rolls with suction boxes and all have the same smaller diameter, and all of the web path reversal suction rolls in the downstream part of that embodiment are suction rolls without suction boxes and all have the 20% and preferably 40% to 60% larger than the smaller diameter. Thus, only two different types of suction rolls are needed in the dryer section according to the invention, which makes it considerably less expensive to produce.

The dryer section usually comprises a conventional series of several dryer groups, each comprised of dryer cylinders, alternate and associated suction rolls, and their associated web supporting, dryer felt which meanders through the dryer groups alternately over a dryer cylinder and over the neighboring suction roll. The junction between the upstream part and the downstream part of the dryer section can be positioned either inside one of the dryer groups or at the transition between two adjacent dryer groups. The dryer cylinders in the upstream part preferably are arranged in one or more upstream part dryer groups and the dryer cylinders in the downstream part are arranged in one or more downstream part dryer groups.

The lower surface of the web preferably comes into contact with and wraps around the top curved part of the dryer cylinders in all of the upstream part dryer groups, facilitating, as is known, the downward removal of broke. The upper surface of the web preferably comes into contact with and wraps around the dryer cylinders in only one of the downstream part dryer groups. It is known that this type of "flipping" between contact between the bottom of the web and dryer cylinders and the top of the web and dryer cylinders will decrease the tendency of the finished paper web to curl. Accomplishing this purpose, however, usually requires that there be only one dryer group with its dryer cylinders contacting the upper surface of the web. The most practical location for this one dryer group is in the downstream part of the dryer section, where the paper is already relatively dry.

Other objects, features and advantages of the present invention will become apparent from the following description of the invention which refers to the accompanying drawings.

DETAILED DESCRIPTION OF A PREFERRED EMBODIMENT

Figure 1:
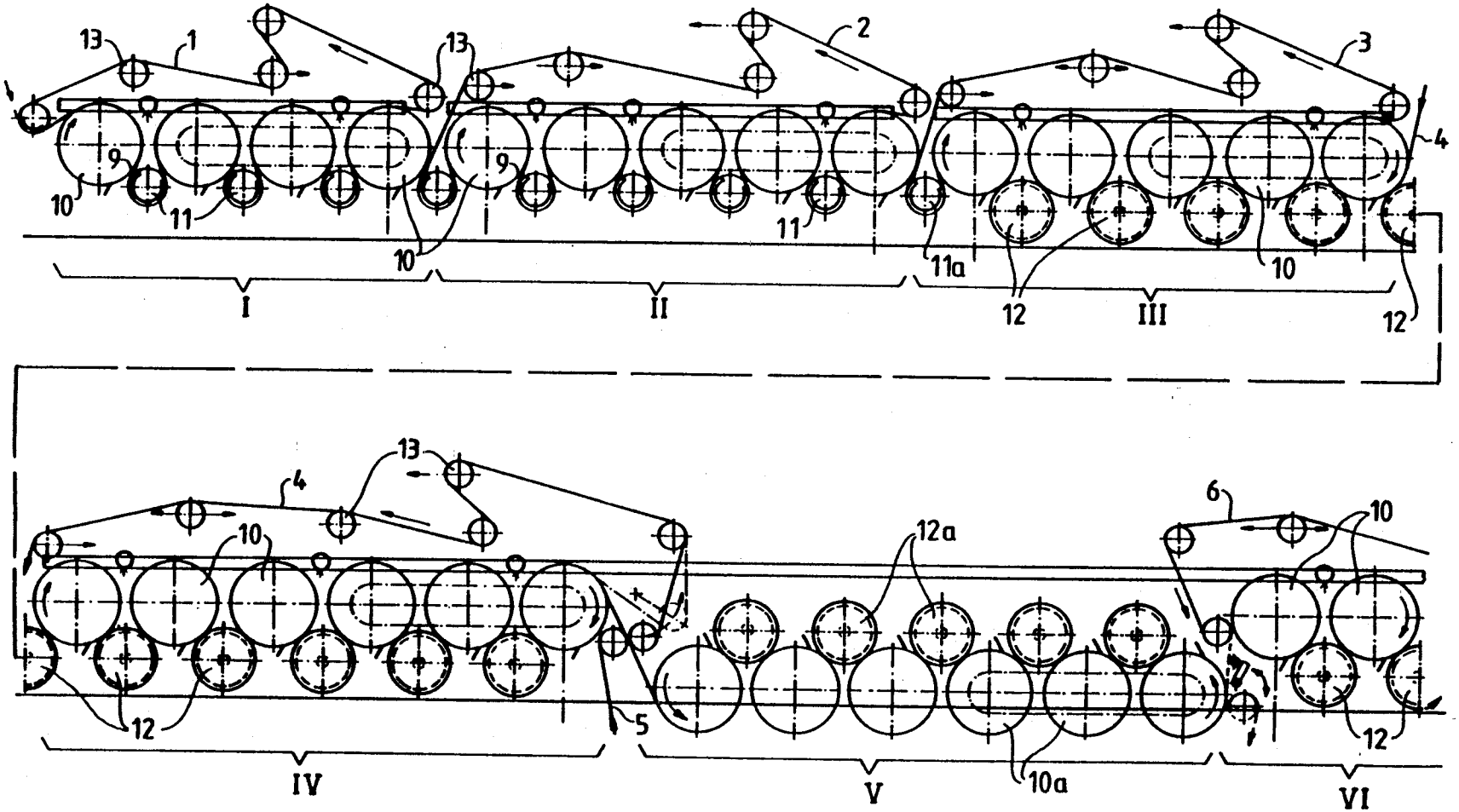
FIG. 1 is a schematic side view of a dryer section of a paper making machine according to the invention.

The dryer section shown in FIG. 1 has six dryer groups I through VI. Each dryer group has its own respective continuous, endless loop, supporting belt e.g. dryer felt, 1 through 6, a series of parallel drying cylinders 10 arrayed along the path of the web through the dryer group, and a series of web path reversal and suction rolls 11 and 12 between neighboring dryer cylinders, as well as conventional belt rolls 13 that tension and adjust the continuous, endless loop belt. Although the illustrated rows of dryer cylinders are horizontal, vertical or sloping rows could also be employed. At least some, if not all, of the suction rolls 11, 12 are symmetrically arranged with respect to their neighboring dryer cylinders, i.e. they are equally spaced from the dryer cylinders and at the same position with respect to the axes of both of the dryer cylinders.

The suction rolls in the first two dryer groups I and II are suction box rolls 11 with a relatively small diameter. Such suction rolls are known in the art, e.g. WO 83/00514. The roll includes an arcuate suction box which is stationary. That suction box defines a suction zone which corresponds approximately to the arcuate region that is wrapped by the supporting belt, e.g. the dryer belt. Suction from a vacuum source is conventionally applied to the suction box. The suction box roll has a perforated peripheral shell which rotates over the stationary suction box. The perforations in the shell then passing over the suction box are then actively applying suction.

Almost all of the suction rolls 12 in the remaining dryer groups III through VI are ordinary suction rolls which lack suction boxes. Each of these ordinary rolls has a hollow rotatable perforated roll shell, and a vacuum is applied to the interior of the roll. The negative pressure or vacuum applied to the roll applies suction through all the perforations in its periphery. The suction rolls 12 also have a greater diameter than the suction box rolls 11. Preferably, the greater diameter suction roll is at least 20% and preferably 40% to 60% larger than the smaller diameter suction box roll. The smaller roll diameter might be approximately 0.7 m and the larger roll diameter might be approximately 1.4 m, for example. The suction rolls 12 are also known in the art, e.g. U.S. Pat. Nos. 3,630,424 or 5,022,163, incorporated by reference.

To facilitate transfer of a web from the second dryer group II to the third dryer group III, however, the first suction roll 11*a* in group III is also a suction box roll, whereby the division between the upstream and downstream parts of the dryer section is within the third dryer group III.

A feature of the invention is the relative densities of the perforations or quantity of perforations per unit of surface area of the shells of the two different types of suction rolls. To enhance the suction by the suction box rolls, the density of their perforations is greater than the density of perforations in the ordinary suction rolls. Preferably, the density of perforations in the shell of the suction box roll is at least twice the density of the perforations in the shell of the ordinary suction rolls. For example, the sum of the cross sectional areas of the perforations may be about 8% of the roll shell surface area in the shell of the suction box roll, while the sum of the cross sectional areas of the perforations may be about 3% of the roll shell surface area in the shell of the ordinary suction roller. This difference occurs due to the diameter of the perforations and/or their spacing apart. For example, comparing FIGS. 2 and 4, the perforations 21 are uniformly spaced apart while the perforations 31 are near each other along a groove 32, but the grooves are more widely spaced axially, decreasing the overall density of perforations.

The suction rolls 11 and 12 in the dryer groups I through IV are all generally below the drying cylinders 10, meaning particularly that the lower supporting belt contacting surface of the suction rolls is below the web contacting top surface of the associated dryer cylinders. As a result, only the lower surface of the web contacts the dryer cylinders in groups I through IV and in the last dryer group, which is incompletely shown in FIG. 1. Flipping from drying one side of the web on dryer cylinders to drying the other side of the web on dryer cylinders occurs in the transition or transfer regions between the dryer groups IV and V and between the dryer groups V and VI. The suction rolls 12*a* in group V, which lack suction boxes, are positioned above the respective neighboring dryer cylinders 10*a*, meaning that the supporting belt contacting top surface of the suction rolls are above the web contacting bottom surface of the associated dryer cylinders. As a result, the upper surface of the web comes into contact with the dryer cylinders in group V only. The web is shown as always supported by a felt wherever it is transferred from one dryer group I through V to the next dryer group. Although this statement also applies to the illustrated flip over point between the dryer groups IV and V, the web is often dry enough by that flip over point, and definitely dry enough by the transition from group V to group VI, to travel unsupported between the dryer groups. Such a transition is illustrated between groups V and VI but not at the transition between groups IV and V. But, as has been discovered by the assignee hereof, it is preferable to provide an open draw of the web in the transfer region between dryer groups where the web is flipped over.

Figure 2:
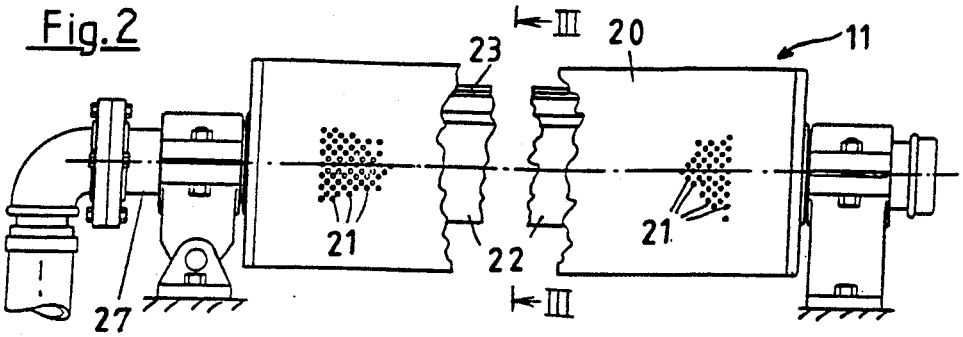
FIG. 2 shows an end view of a suction box roll.
Figure 3:
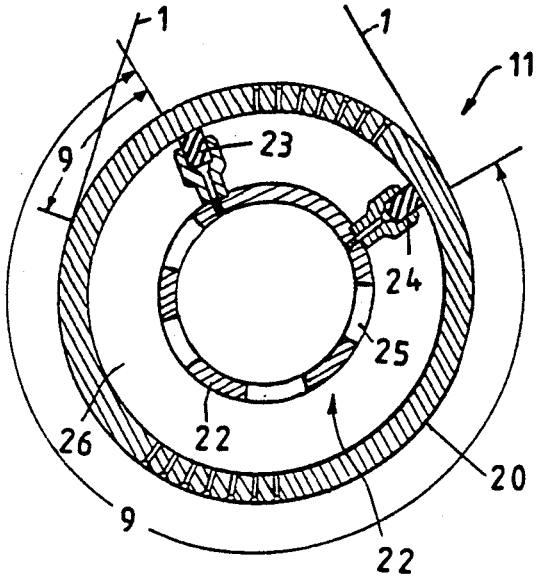
FIG. 3 shows a cross section of the suction box roll along line III of FIG. 2, on an enlarged scale.

The suction roll 11 shown in FIGS. 2 and 3 has a perforated roll shell 20. The perforations 21 are evenly arranged and dispersed around the periphery of roll shell 20. Only an exemplary few of them are shown in two axially spaced groups in FIGS. 2 and in two circumferentially spaced groups in FIGS. 3. The perforations 21 may also be evenly arranged along the axial or cross machine length of roll shell 20 but within the width of the web. Thus, the two groups illustrated terminate before the axial ends of the roll. The density of the perforations 21 is relatively great. If required, the density may be greater in the two edge zones than in the middle zone of the web width which is known per se. A stationary suction box 22 extends axially through the interior of roll shell 20. It comprises a tube 22*a* and two circumferentially separated, longitudinal axial seals 23, 25 which define a suction zone 9, extending circumferentially around most of the roll. Openings 25 connect the interior of tube 22*a* to the annular space 26 between tube 22*a* and roll shell 20 but only in the circumferential area of suction zone 9. A suction pipe 27 connects the suction box 22 to a vacuum source (not shown). The rotatable roll shell 20 is supported in bearings (not shown).

Figure 5:
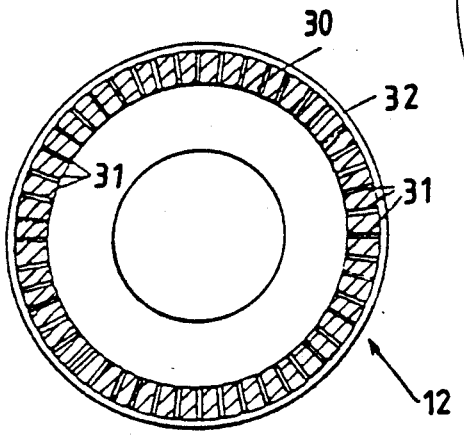
FIG. 5 is a cross section of the suction roll of FIG. 4 along the line V of FIG. 4.
Figure 4:
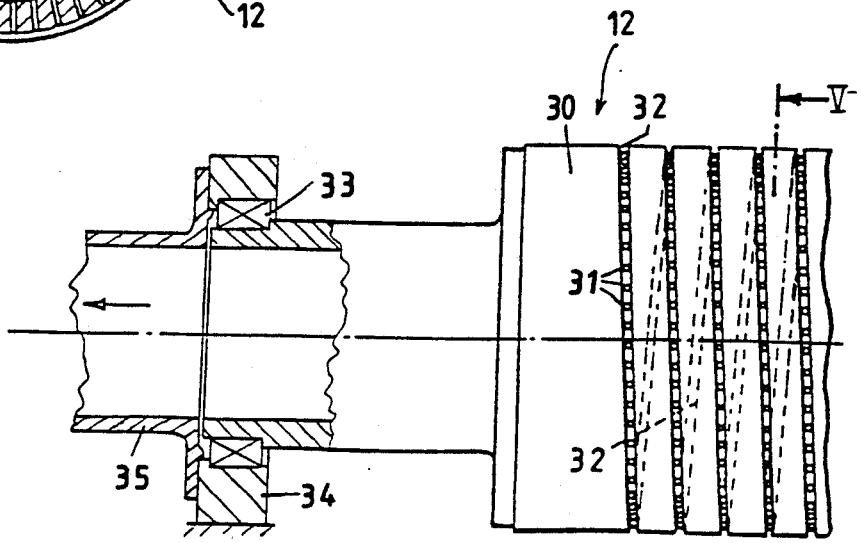
FIG. 4 shows an end view of one end of an ordinary suction roll without a suction box.

The non-suction box suction roll 12 shown in FIGS. 4 and 5 has also a perforated roll shell 30. The perforations 21 may also be evenly or uniformly arranged both circumferentially and axially. The perforations may connect the interior of roll shell 30 to peripheral grooves 32 which may be annular or helically wound in the shell, as shown in FIG. 4. Important to the invention is that the density of the perforations 31 is less than the density of the perforations in suction roll 11. The ratio of densities is noted above. The interior of the roll 12 is free of a suction box. Roll shell 30 is supported in two bearings 33 of which one is shown, comprising a stationary housing 34 to which a suction pipe 35 is connected.

Suction box rolls 11 and 11*a* have a circumferentially extended suction zone or an additional pre- suction zone 9*a*, as in FIG. 3, to eliminate the boundary air layer that arrives with the supporting belt. The ordinary rolls 12 and 12*a* have a portion of their circumference which is not wrapped by the supporting belt and is generally open toward the "pocket" between the two adjacent drying cylinders. The relatively lower density of perforations nevertheless ensures that only relatively little "false air" will be suctioned or drawn in at that portion of the shell not wrapped by the belt.

The second suction rolls 12 without suction boxes are of at least 20% and preferably 40% to 60% larger diameter than the first suction rolls 11 with suction boxes and the second suction rolls 12 also have a diameter that is generally between 50% to 80% of the diameter of the respective neighboring dryer cylinders.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A dryer section for a machine for drying a fibrous web, the dryer section comprising:

a plurality of heated dryer cylinders arranged one after the other along a path of the web to be dried;

a respective suction roll disposed between neighboring ones of the dryer cylinders; each suction roll having a perforated roll shell;

at least one continuous porous supporting belt having an outer surface for supporting the web, and the web traveling in a meander path alternately over each dryer cylinder and the neighboring suction roll, wherein the web supported on the outer surface of the belt directly contacts the dryer cylinders while the belt contacts the suction rolls;

the dryer cylinders are grouped into an upstream part, which is upstream along the path of the web through the dryer section, and a downstream part, which is downstream of the upstream part along the path of the web through the dryer section; first ones of the suction rolls being associated with the dryer cylinders grouped in the first part; second ones of the suction rolls being associated with the dryer cylinders grouped in the second part;

each first suction roll having a stationary suction box which remains stationary and the roll shell of each first roll rotating around and over the stationary suction box; the perforations in the roll shell of each first suction roll having a greater density for applying relatively greater suction through the belt passing thereover to the web supported on the outer surface of the belt;

each second suction roll being without a suction box; the perforations in the roll shell of the second suction roll having a lesser density for applying relatively lesser suction than is applied through the perforations in the first roll, through the belt passing thereover to the web supported on the outer surface of the belt.

2. The dryer section of claim 1, wherein the density of the perforations of the first suction roll is at least twice as great as the density of the perforations of the second suction roll.

3. The dryer section of claim 1, wherein the diameter of the second suction rolls is generally between 50% to 80% of the diameter of the second dryer cylinders.

4. The dryer section of claim 1, wherein the first suction rolls have a smaller diameter than the second suction rolls.

5. The dryer section of claim 4, wherein the diameter of the second suction rolls is generally between 50% to 80% of the diameter of the second drying cylinders.

6. The dryer section of claim 4, wherein the diameter of the second suction rolls is at least 20% greater than the diameter of the first suction rolls.

7. The dryer section of claim 6, wherein the diameter of the second suction rolls is about 40% to 60% larger than the diameters of the first suction rolls.

8. The dryer section of claim 1, wherein at least some of the suction rolls are symmetrically disposed with respect to the neighboring dryer cylinders being equally spaced therefrom and at the same position with respect to the axis thereof.

9. The dryer section of claim 1, wherein there is a first one of the supporting belts in the upstream part and a second one of the supporting belts in the downstream part, and the first and second supporting belts are separate from each other.

10. The dryer section of claim 9, further comprising means for supporting the first and the second belts for enabling transfer of the web from the first belt to the second belt.

11. The dryer section of claim 9, wherein the dryer cylinders are grouped into respective dryer groups, each including respective ones of the dryer cylinders and of the neighboring suction rolls and being defined by a respective one of the supporting belts; in each dryer group, the suction rolls being either above or below the respective neighboring dryer cylinders.

12. The dryer section of claim 11, wherein at least a first one of the dryer groups is in the upstream part and the next second dryer group along the path of the web is in the downstream part;

at least some of the suction rolls in the first dryer group and at least some of the suction rolls in the second dryer group are at least in part below their neighboring dryer cylinders, and the web is so supported on the supporting belt and the supporting belt passes in such a meander path that the web lower surface comes into contact generally with the top surface of the dryer cylinders of the first and second dryer groups where the suction rolls are below the dryer cylinders.

13. The dryer section of claim 12, further comprising an additional third group of the dryers included in the upstream part, and the suction rolls of the third dryer group being generally below the dryer cylinders of the third group; and the respective supporting belt passing through the third dryer group so supporting the web thereon that the lower surface of the web comes into contact with the dryer cylinders of the third group.

14. The dryer section of claim 12, further comprising at least one additional third downstream dryer group, downstream of the second dryer group and in the downstream part.

15. The dryer section of claim 14, wherein the suction rolls in the additional third dryer group are generally above the dryer cylinders in the third dryer group and the respective supporting belt passing through the third dryer group so supporting the web on the outer surface of the supporting belt that the upper surface of the web comes into contact with the bottom side of the dryer cylinders in the third dryer group.

* * * * *